US008177399B2

(12) United States Patent
Tragatschnig

(10) Patent No.: US 8,177,399 B2
(45) Date of Patent: May 15, 2012

(54) DESK LAMP WITH PARALLEL GUIDANCE

(75) Inventor: Joerg Tragatschnig, Zell am See (AT)

(73) Assignee: Zumtobel Lighting GmbH, Dornbirn (AT)

( * ) Notice: Subject to any disclaimer, the term of this patent is extended or adjusted under 35 U.S.C. 154(b) by 525 days.

(21) Appl. No.: 12/307,856

(22) PCT Filed: Aug. 2, 2007

(86) PCT No.: PCT/EP2007/006866

§ 371 (c)(1),
(2), (4) Date: Feb. 18, 2009

(87) PCT Pub. No.: WO2008/017422

PCT Pub. Date: Feb. 14, 2008

(65) Prior Publication Data

US 2009/0189538 A1 Jul. 30, 2009

(30) Foreign Application Priority Data

Aug. 9, 2006 (DE) ..... 20 2006 012 245 U

(51) Int. Cl.
*F21V 21/20* (2006.01)

(52) U.S. Cl. ..... 362/401; 362/410; 362/427

(58) Field of Classification Search ..... 362/401, 362/410, 402, 441, 427, 452, 454, 444, 414
See application file for complete search history.

(56) References Cited

U.S. PATENT DOCUMENTS

| | | | | |
|---|---|---|---|---|
| 3,790,773 | A | 2/1974 | Sapper | |
| 4,772,991 | A | 9/1988 | Wood | |
| 4,875,648 | A | 10/1989 | Guarnori | |
| 5,176,443 | A * | 1/1993 | Lin | 362/413 |
| 5,222,806 | A | 6/1993 | Roberts, III | |
| 6,260,983 | B1 | 7/2001 | Chiu | |
| 6,599,000 | B2 * | 7/2003 | Nolan et al. | 362/414 |
| 7,019,464 | B2 * | 3/2006 | Nevins | 315/149 |

FOREIGN PATENT DOCUMENTS

| | | |
|---|---|---|
| DE | 17 64 585 | 9/1971 |
| DE | 200 02 302 | 4/2000 |

OTHER PUBLICATIONS

International Search Report for PCT/EP2007/006866 dated Nov. 2, 2007.

* cited by examiner

*Primary Examiner* — John A Ward
(74) *Attorney, Agent, or Firm* — Marshall, Gerstein & Borun LLP

(57) ABSTRACT

In a lamp, in particular a desk lamp, with a base plate (2) and a lamp head (3), the lamp head (3) is held on the base plate (2) via two profile elements (4, 5) running next to one another, wherein the profile elements (4, 5) represent current-conducting elements.

19 Claims, 9 Drawing Sheets

DESK LAMP WITH PARALLEL GUIDANCE

BACKGROUND OF THE INVENTION

1. Field of the Invention

The present invention relates to a lamp, in particular a desk lamp with a base plate and a lamp head.

2. Related Technology

In the case of a desk lamp with a base plate and a lamp head, the current is usually first fed to the base plate and in a further section from the base plate to the lamp head. The section between the base plate and the lamp head generally has the set task of realizing the current-conduction in a suitable way. In this connection, it is known from the prior art, for example, that for the current feed it is possible to provide electric leads that extend within a tubular holding support with which the lamp head is held on the base plate.

SUMMARY OF THE INVENTION

The invention provides a lamp with alternative current-conduction between the base plate and the lamp head. In this case, the specified solution to the problem of achieving the object shall preferably be with regard to the possibilities for the configuration of the lamp.

Accordingly, the invention provides a lamp, in particular a desk lamp, having a base plate and a lamp head wherein the lamp head is mounted on the base plate by two profile elements extending side by side, wherein the profile elements are current-conducting elements.

In accordance with the invention, a lamp, in particular a desk lamp, is provided that has a base plate and a lamp head. In accordance with the invention, in this case the lamp head is held on the base plate by way of two profile elements extending side by side. the profile elements present current-conducting elements.

The profile elements thus serve to hold the lamp head on the base plate and function, moreover, as current-conducting elements. As a result of this double function, the possibilities for the configuration of the lamp are improved, since there is no need for there to be two separate elements for the two functions mentioned.

The profile elements are preferably made of aluminum. It is preferred, furthermore, that the profile elements have joints in order to make it possible to adjust the lamp head into a desired position. The joints can then be adapted in terms of their size to the cross-section of the profile elements. For example, it can be provided that the joints do not project beyond this cross-section, as a result of which the appearance of the profile elements can be configured to extend in a uniform way and thus in a stylish manner.

The joints can, furthermore, preferably have electrically conductive elements in order to assist the current-conduction. As a result, the current-conduction can be made particularly reliable or the quality of the current-conduction can be improved. The electrically conductive elements can, for example, be provided in the form of spring elements.

Furthermore, it is preferred if a plurality of profile elements are provided that are connected by means of the joints and set up a profile run extending throughout from the base plate to the lamp head. In particular, it can be provided that in this case the profile elements are each connected directly by means of the joints. In a particularly preferred manner, in this case two profile runs are set up that each extend throughout and separately from each other from the base plate to the lamp head. In this case, one of the two profile runs can be provided for current-conduction from the base plate to the lamp head, and the other profile run can be provided for current-conduction from the lamp head to the base plate.

Furthermore, it is preferred to provide in a section between the two profile elements a guide element that renders possible guided parallel displacement of the two profile elements. As a result, a supporting force can be obtained in various positions of the lamp head relative to the base plate or in the case of a corresponding movement of adjustment. Preferably, means are then provided with which it is possible to set a frictional force that occurs in the case of the parallel displacement of the profile elements. As a result, the stability can be further increased in certain positions or in the case of certain movements of adjustment.

For the development of the guide element it is preferred if the guide element has two interlocking rail elements that can be displaced parallel to each other. In this case, it can be provided that a respective rail element is fixed in a stable manner on in each case one of the two profile elements.

Furthermore, an end stop is preferably provided for the guided parallel displacement of the two profile elements. This end stop can, for example, be provided on or in the guide element.

Preferably, a spring element is provided which, in the case of a parallel displacement of the two profile elements, produces a restoring force that acts on the profile elements. In particular, it can be provided that in the case of a parallel displacement of the two profile elements resulting in a reduction in the total length of the unit, consisting of the two profile elements, a restoring force is produced that presses the two profile elements apart for the purposes of lengthening the unit.

Preferably, the guide element in all of the intended positions of the lamp head relative to the base plate guarantees electrical insulation of the two profile elements. As a result, a further portion designed separately for this purpose becomes unnecessary.

Preferably, the lamp head has a light source that includes an LED. For example, a high-power LED can be provided as a light source, preferably having a plurality of closely lying light points. In this connection, it is preferred, furthermore, if the lamp head has a reflector through which the light of the light source is emitted asymmetrically.

As regards greater ease of operation of the lamp it is preferred to provide an operating part on the lamp head, preferably on the end face. This can comprise, for example, a switch to switch the lamp on and off and/or a further switch to control the brightness of the lamp. The switches can be provided as buttons. An electronic component to dim the lamp can be provided in the lamp head.

The base plate is preferably configured in such a way that rotation of the rest of the lamp relative to the base plate is possible, that is, preferably about an axis that is orientated perpendicularly with respect to the base plate, that extends vertically for example.

BRIEF DESCRIPTION OF THE DRAWINGS

The invention is explained in greater detail in the following with the aid of an exemplary embodiment and with reference to the drawings, in which.

DETAILED DESCRIPTION

Figure 1:
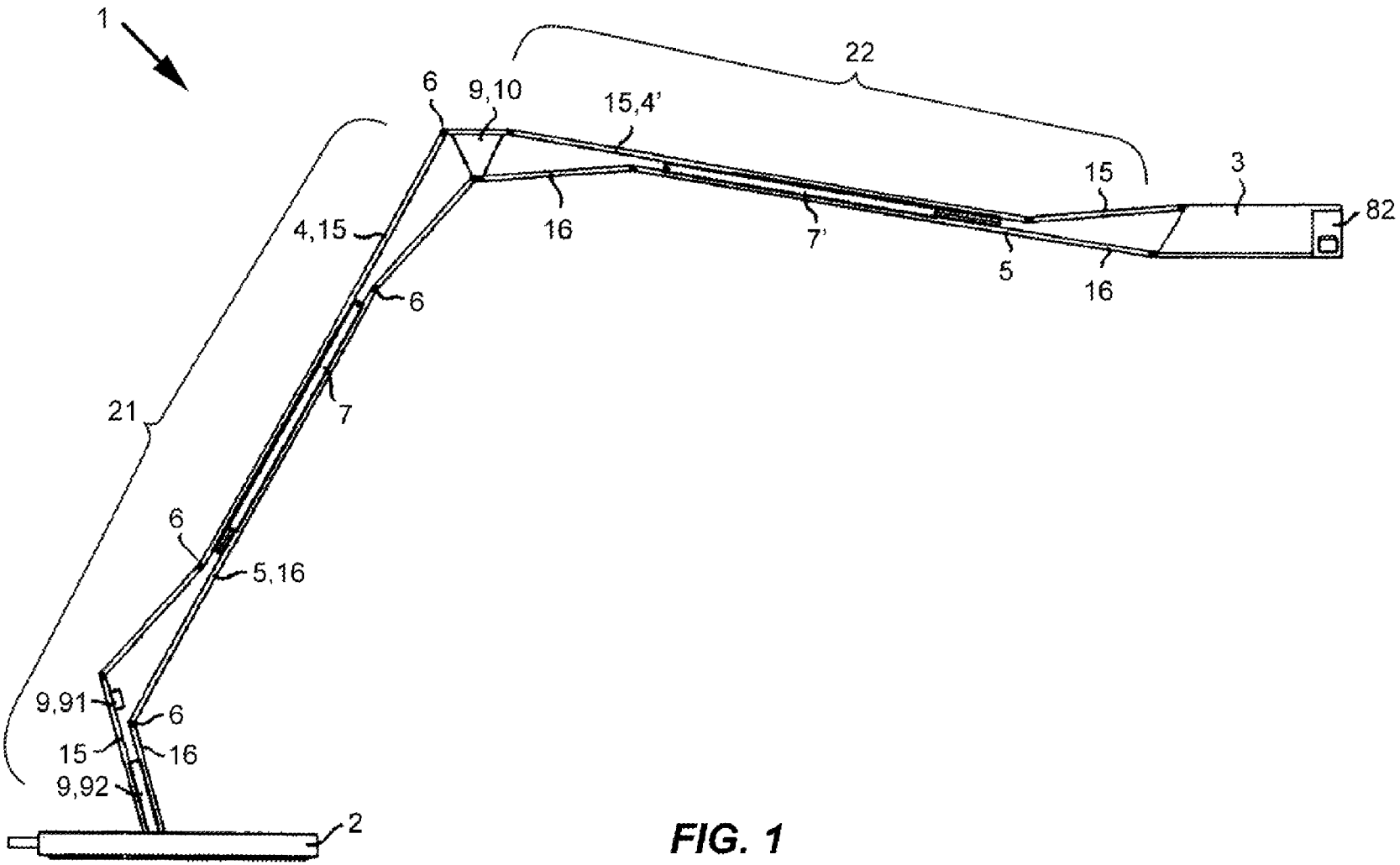
FIG. 1 shows a side view of a lamp in accordance with the invention in a first working position.
Figure 2:
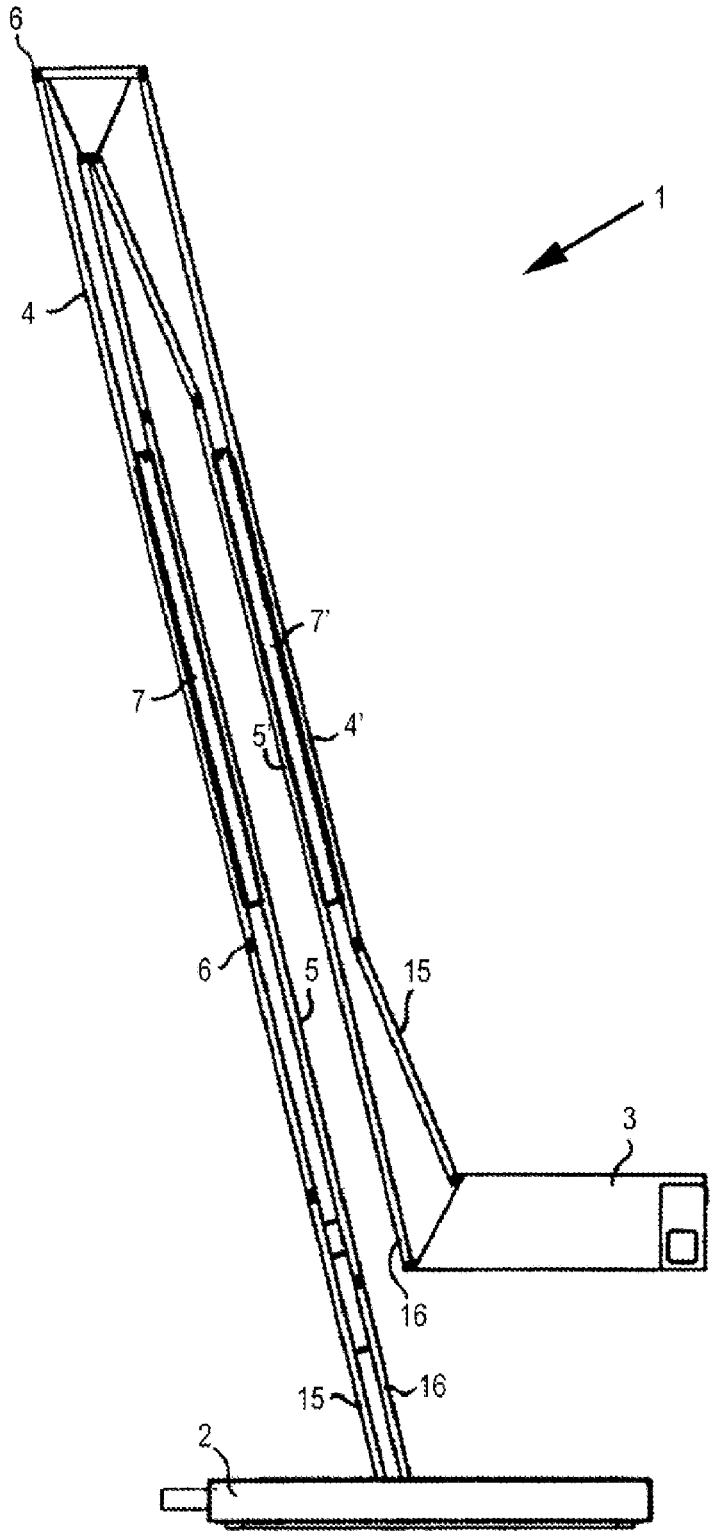
FIG. 2 shows a side view of the lamp according to FIG. 1 in a rest position.
Figure 3A:
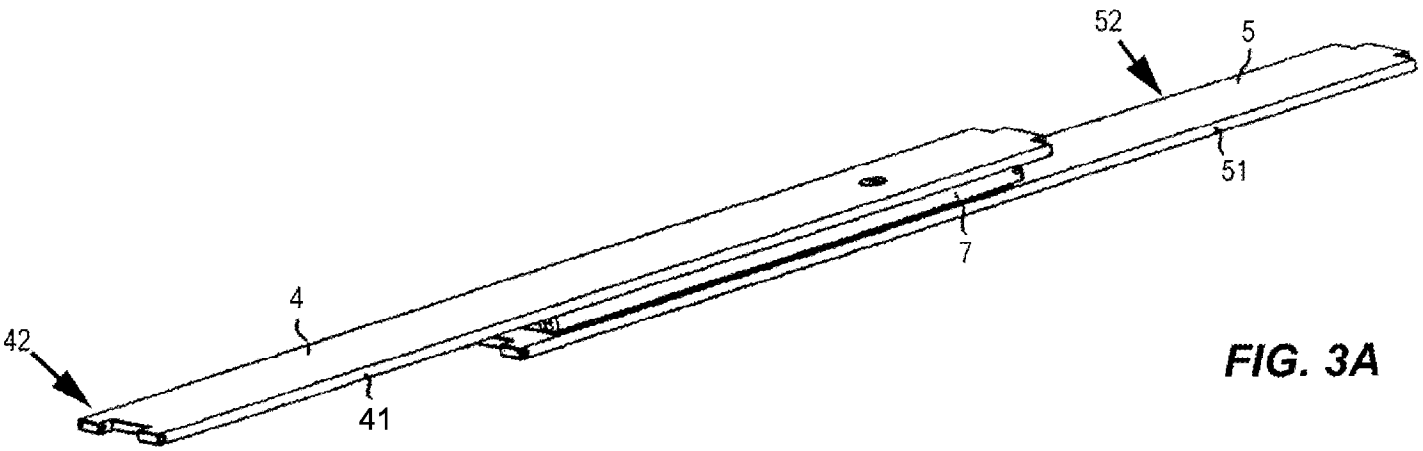
FIGS. 3A and 3B show perspective views of two profile elements and a guide element, in part in a state in which they are separated from each other.
Figure 3B:
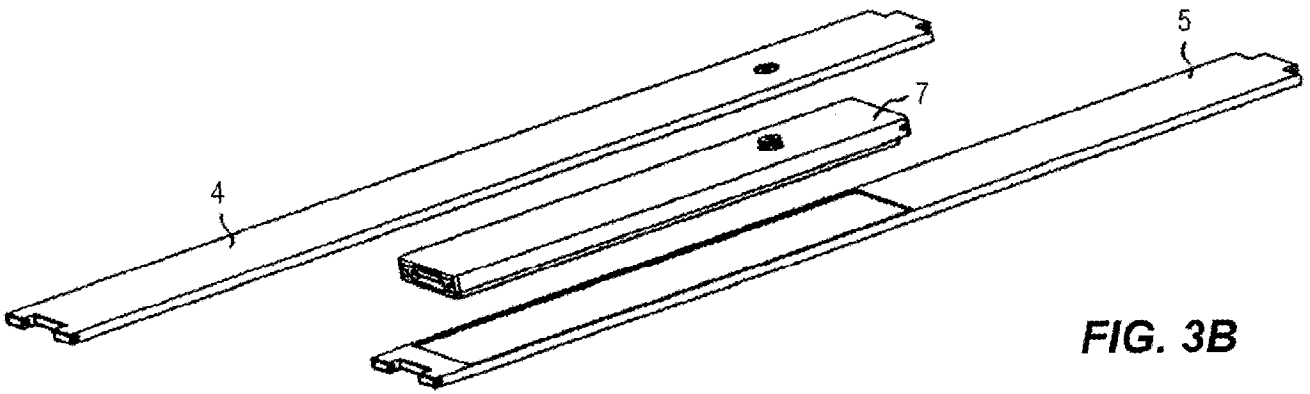

An exemplary embodiment of a lamp 1 in accordance with the invention is shown in side views in FIGS. 1 and 2. The lamp 1 comprises a base plate 2 and a lamp head 3 which can be adjusted relative to the base plate 2 into various positions or "working positions" or situations. FIG. 1 shows the lamp 1 in a state in which a first "working position" is set; FIG. 2 shows the lamp 1 in a space-saving "rest position".

The lamp head 3 is held on the base plate 2 by way of two elongated profile elements 4, 5 that are made of aluminum and extend side by side. In this case, the profile elements 4, 5 present current-conducting elements by way of which the lamp head 3 is supplied with current. The profile elements 4, 5 are spaced apart from each other for this throughout. A low-volt voltage is provided for the current-conduction.

In the exemplary embodiment, the profile elements 4, 5 have a respective joint portion at their ends, being connected thereby in an articulated manner by way of these joint portions respectively to further profile elements so that therefore between two adjacent profile elements a respective articulated connection point, or in short a joint 6, is formed. In this way, a first and a second profile run 15, 16 are set up, with these two profile runs 15, 16 each extending throughout and separately from each other directly from the base plate 2 directly to the lamp head 3. The profile elements of a profile run can then in each case be of generally differing lengths, yet have identical cross-sections. Furthermore, in the exemplary embodiment the cross-sections of the profile elements of both profile runs are identical.

The two profile runs 15, 16 can be moved into various situations with the aid of the joints 6 so that in this way adjustment of the position of the lamp head 3 in relation to the base plate 2 is rendered possible.

As becomes clear when looking at FIGS. 1 and 2, in the exemplary embodiment in total six joints 6 are provided for the first profile run 15: one joint 6 is provided directly at the lamp head 3. This can be seen in greater detail in FIG. 7. The same holds good in a corresponding way for the second profile run 16.

No corresponding joints 6 are provided at the two points of connection of the profile runs 15, 16 to the base plate 2. At this point, the lamp 1 is configured in such a way that the impression that is formed for the person looking at the lamp is that the profile runs 15, 16 run out of the base plate 2, so to speak, without any obvious securement. This is also shown in perspective view in FIG. 8.

In FIGS. 3 to 6 perspective views are shown from which it is apparent that the profile elements 4, 5 have a rectangular cross-section. As indicated in FIG. 3A, the first profile element 4 thus has two side walls 41, 42, and the second profile element 5 has two side walls 51, 52. These side walls 41, 42, 51, 52 are configured in the exemplary embodiment in such a way that they differ visually from the rest of the visible surfaces of the profile elements 4, 5, for example as a result of greater brightness. Surface treatment, for example, can be provided for this; for example the side walls can be polished to this end. The same holds good in a corresponding way for the further profile elements of the profile runs 15, 16 so that when looking at the lamp 1 from the side in each case a visually prominent, continuous structure can be identified between the base plate 2 and the lamp head 3.

Figure 6A:
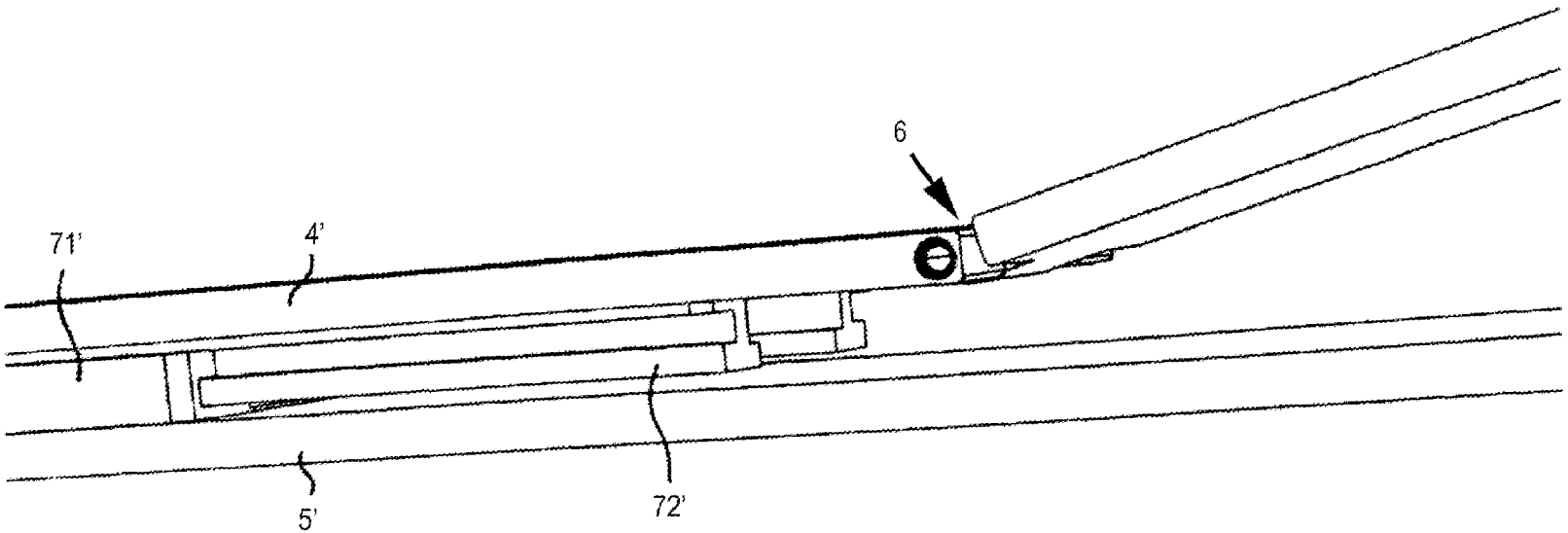
FIGS. 6A and 6B show two further perspective detailed views with a joint connection.
Figure 6B:
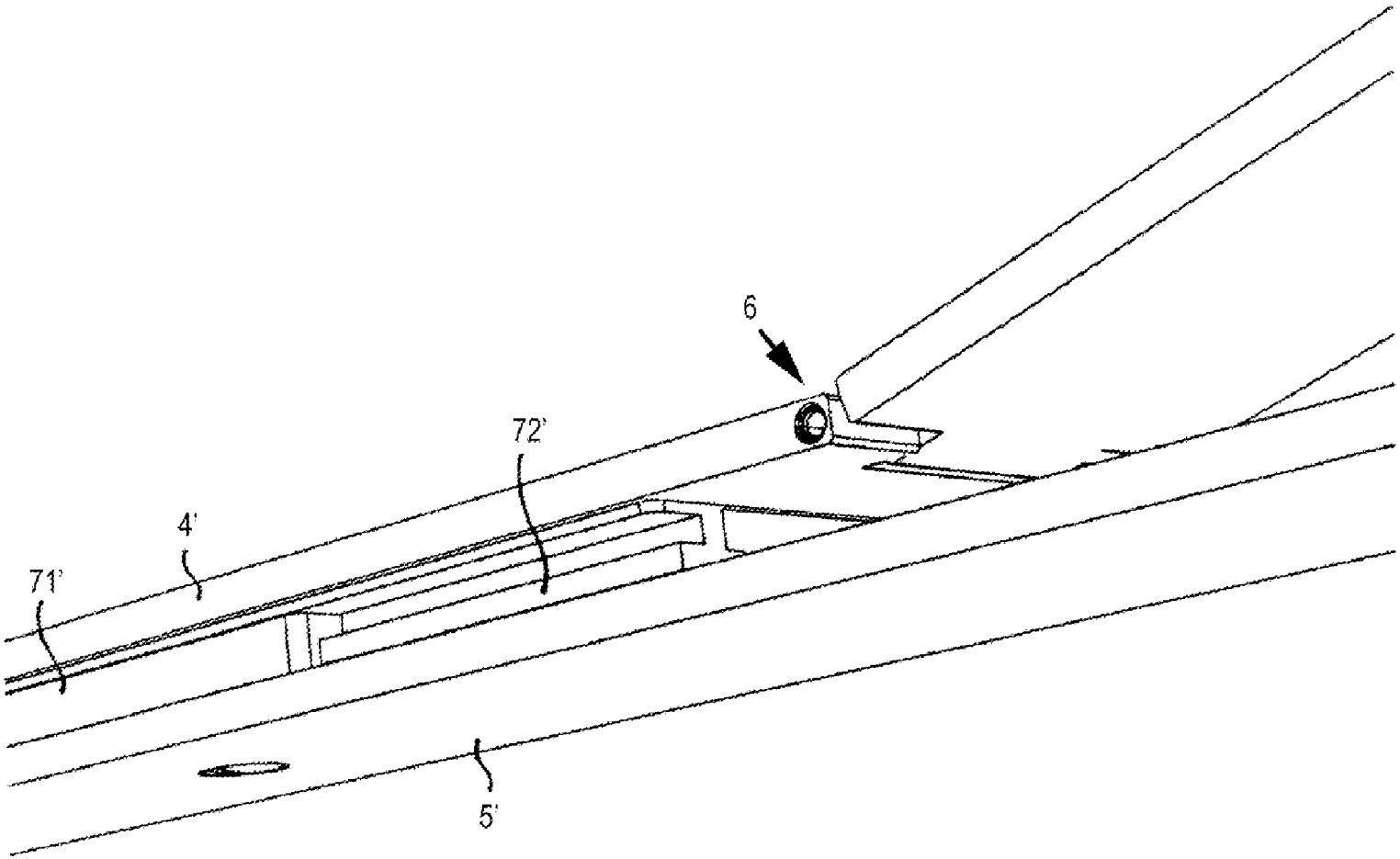

A joint 6 is shown in greater detail in the two detailed representations of FIGS. 6A and 6B. Provided in the joints 6 there are respective integrated spring elements that are electrically conductive and guarantee or assist electrical contacting between the individual profile elements of a profile run.

The joints 6 are adapted in terms of their size to the cross-section of the profile elements. They are accommodated in the profile thickness. This renders possible a configuration of the joint regions that that is as inconspicuous as possible visually or even invisible.

Furthermore, in the case of this exemplary embodiment a guide element 7 is provided with which a guided parallel displacements displacement of the two profile elements 4, 5 is rendered possible. The guide element 7 is arranged in a certain section or region between the two profile elements 4, 5.

In FIGS. 3A, 3B, 4A and 4B, the profile elements 4, 5 and the guide element 7 arranged in between are shown in various representations. It can best be seen in FIGS. 4A and 4B that the guide element 7 has two rail elements 71, 72 which interlock in the assembled state and can be displaced parallel to each other. The first rail element 71 is then secured in a stable manner on the profile element 4, and the second rail element 72 is secured in a corresponding manner on the profile element 5.

The guide element 7 is dimensioned in such a way that laterally it does not protrude beyond the two profile elements 4, 5.

As follows from FIGS. 1 and 2, in the case of the exemplary embodiment, moreover, yet a further guide element 7' is provided that is arranged between corresponding further profile elements 4', 5' of the profile runs 15, 16. In the exemplary embodiment, the two guide elements 7, 7' are structurally identical. The two rail elements 71', 72' of the further guide element 7' can be seen in FIGS. 6A and 6B. FIGS. 6A and 6B then show the two profile elements 4', 5' in a state in which they are partly pushed apart, that is, in a state that corresponds to the working position shown in FIG. 1.

The two guide elements 7, 7' are configured in such a way that the visual appearance of the profile runs 15, 16 extending throughout is not or at least is not substantially disturbed by the guide elements 7, 7'.

With reference to the current-conduction, furthermore, the configuration of the guide elements 7, 7' is such that they guarantee spacing of the two corresponding profile elements 4, 5 and 4', 5' respectively in all of the intended positions of the lamp head 3 with regard to the base plate 2. The guide elements 7 are accordingly produced from an electrically non-conductive material.

The joints 6 are configured in such a way that they do not generate any appreciable frictional force; also in other respects they do not assist, at least in an appreciable way, with the movement when the lamp head 3 is adjusted into a different position or with the stability of a position of the lamp head 3 once set. On the contrary, this is guaranteed or at least assisted by way of the two guide elements 7, 7'. This is achieved in the first instance by virtue of the fact that the guide elements 7, 7', as mentioned, each guarantee a certain spacing between the two corresponding profile elements 4, 5 and 4', 5' respectively.

Besides this, in order to assist still further with the stability of the lamp 1 in various positions or when adjusting the lamp head 3, in particular in order to assist with a balancing of the whole joint-arm arrangement, a device is provided, furthermore, for integrated spring assistance. In the case of the exemplary embodiment shown here, this device comprises a spring element 73 with which, in the case of a parallel displacement of the two profile elements 4, 5, a restoring force is caused to act on the profile elements 4, 5. As follows from FIG. 4B, in the exemplary embodiment the spring element 73 is fixed, on the one hand, by way of the first rail element 71 on the first profile element 4 and, on the other hand, by way of the second rail element 72 on the second profile element 5. In order to hold the spring element 73, the device further comprises, on the one hand, a first holding element 74 which is connected to the first profile element 4 in a stable manner and, on the other hand, a second holding element 75 which is connected to the second profile element 5 in a stable manner or is suspended on the latter. The spring element 73 is stretched between the two holding elements 74, 75 so that, when the two profile elements 4, 5 are pushed together, the device for integrated spring assistance produces a force that presses the two profile elements 4, 5 apart.

The device for integrated spring assistance is arranged in the guide element 7, that is, in such a way that in the assembled state it is not visible from without or at least is not visible to an appreciable extent. In the exemplary embodiment, the spring element 73 is arranged in an interior space that is formed by the two rail elements 71, 72.

Figure 4A:
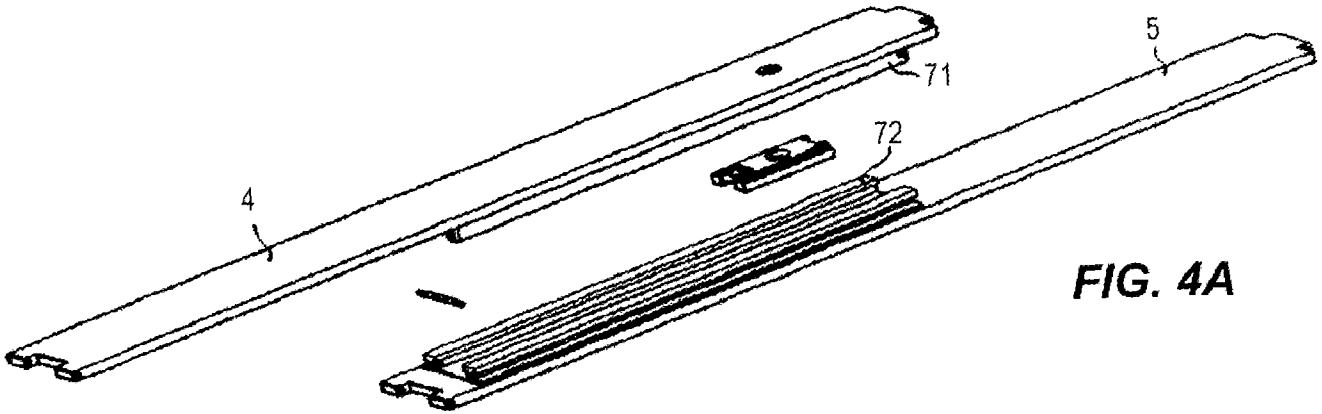
FIGS. 4A and 4B show views that substantially correspond to FIGS. 3A and 3B and in which the guide element is opened.
Figure 4B:
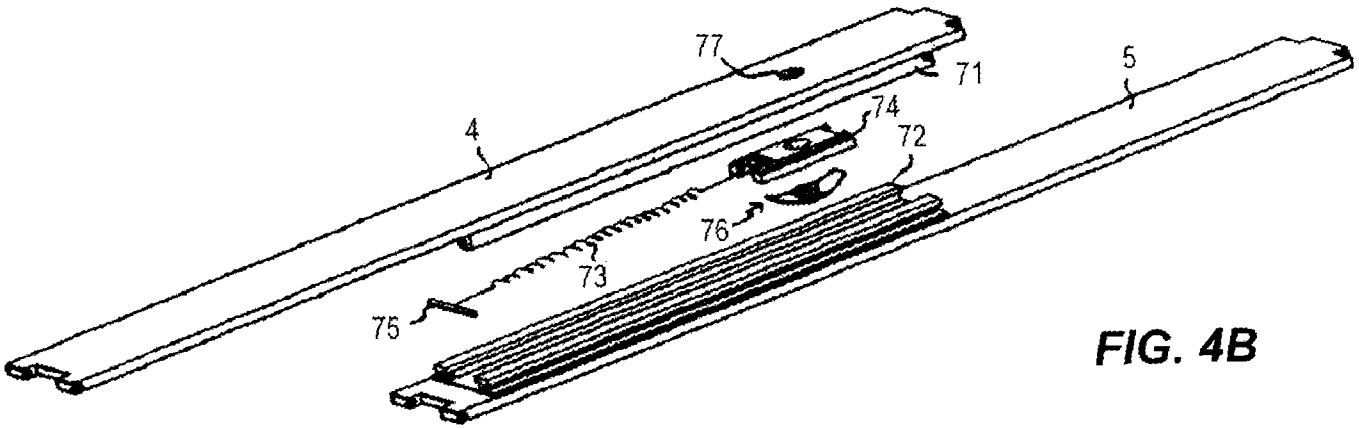
Figure 5:
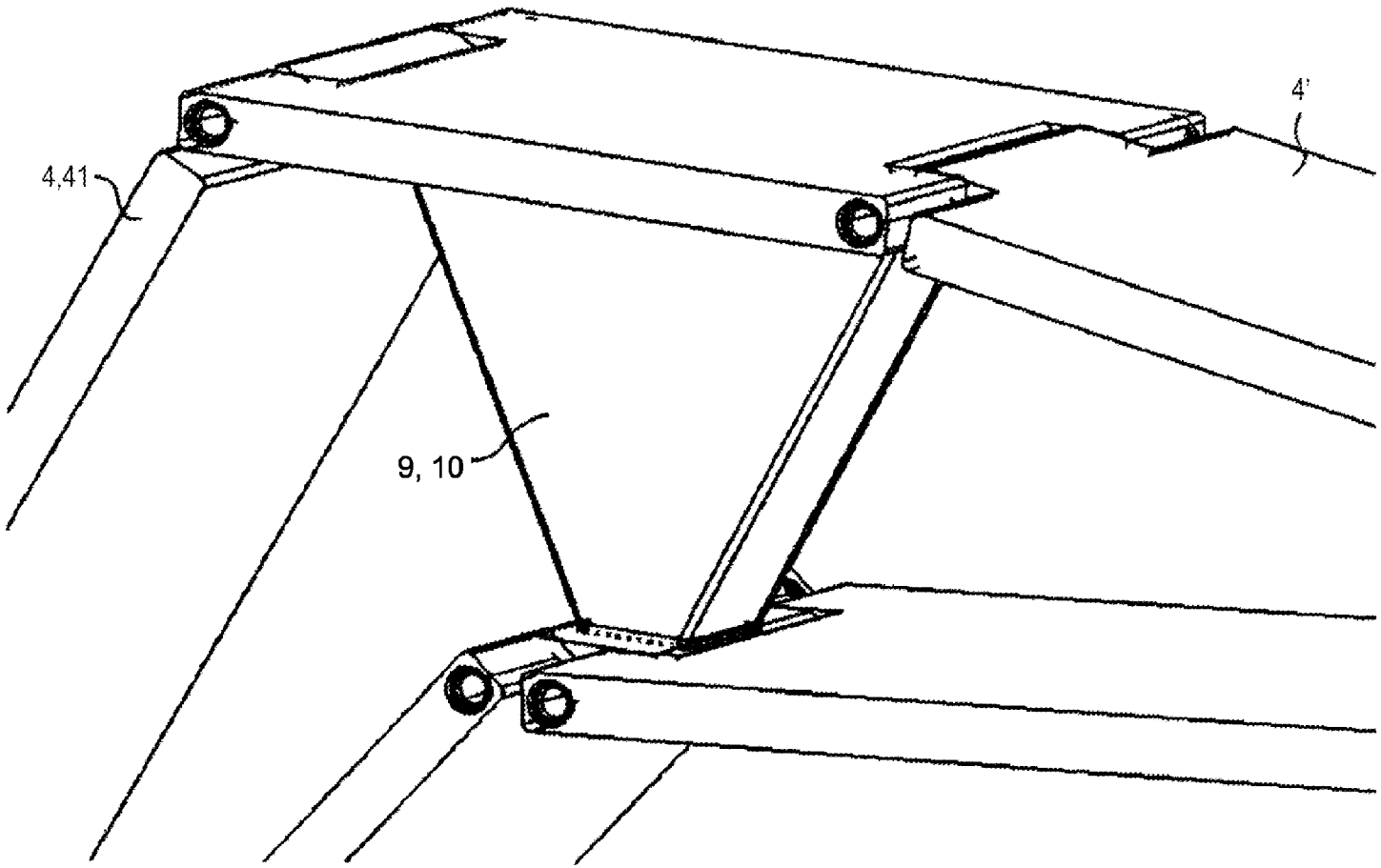
FIG. 5 shows a triangular spacing element.

For further-reaching assistance of the kinematics or stability of the setting positions of the lamp head 3, it is provided, moreover, that the frictional force that occurs during the parallel displacement of the two profile elements 4, 5, is settable. As indicated in FIGS. 4A and 4B, provided within the two rail elements 71, 72 of the guide element 7 there is a friction element, in the form of a leaf spring 76 for example, with the aid of which the frictional force that occurs in the case of parallel displacement of the profile elements 4, 5 is settable. In the exemplary embodiment, a screw 77 is provided for this that passes through one of the two profile elements 4, 5, here the profile element 4, from without; by rotating the screw 77 it is possible to vary a spring force of the friction element in an operator-friendly manner. In the exemplary embodiment, the screw 77 is used in a material-saving manner, moreover, to fix the first holding element 74 of the spring element 73 on the profile element 4. The same holds good in a corresponding manner in turn for the further guide element 7'.

Furthermore, provided for the guided parallel displacement of the two profile elements 4, 5 and 4', 5' respectively there are respective end stops that can likewise be realized by means of the guide elements 7, 7'.

The integrated functions of the guide elements 7, 7' are therefore parallel guidance of the profile elements 4, 5 and 4', 5' respectively, integrated spring assistance, a settable frictional force, and also end stops.

In the case of the exemplary embodiment, in addition to the two guide elements 7, 7' three spacing elements 9 are further provided between the two profile runs 15, 16 for spacing purposes and for assisting with the holding-support function of the two profile runs 15, 16. All the connections of the two profile runs 15, 16, here therefore the two guide elements 7, 7' and the three spacing elements 9, are configured in an electrically insulated embodiment, for example as plastics portions.

As indicated in FIG. 1, the two continuous profile runs 15, 16 can be divided into two main arms 21 and 22 that are separated from each other by means of one of the spacing elements 9, that is, by means of a triangular portion 10, preferably made from plastics material. The triangular portion 10 further assists with the stability of the lamp 1 in various positions of the lamp head 3 and ensures that there is the necessary positioning. With reference to the representations of FIGS. 1 and 2, arranged above and below the triangular portion 10 there is a respective short profile section of the profile runs 15, 16 with in each case two joints 6, that is, as shown in greater detail in FIG. 5.

Figure 8:
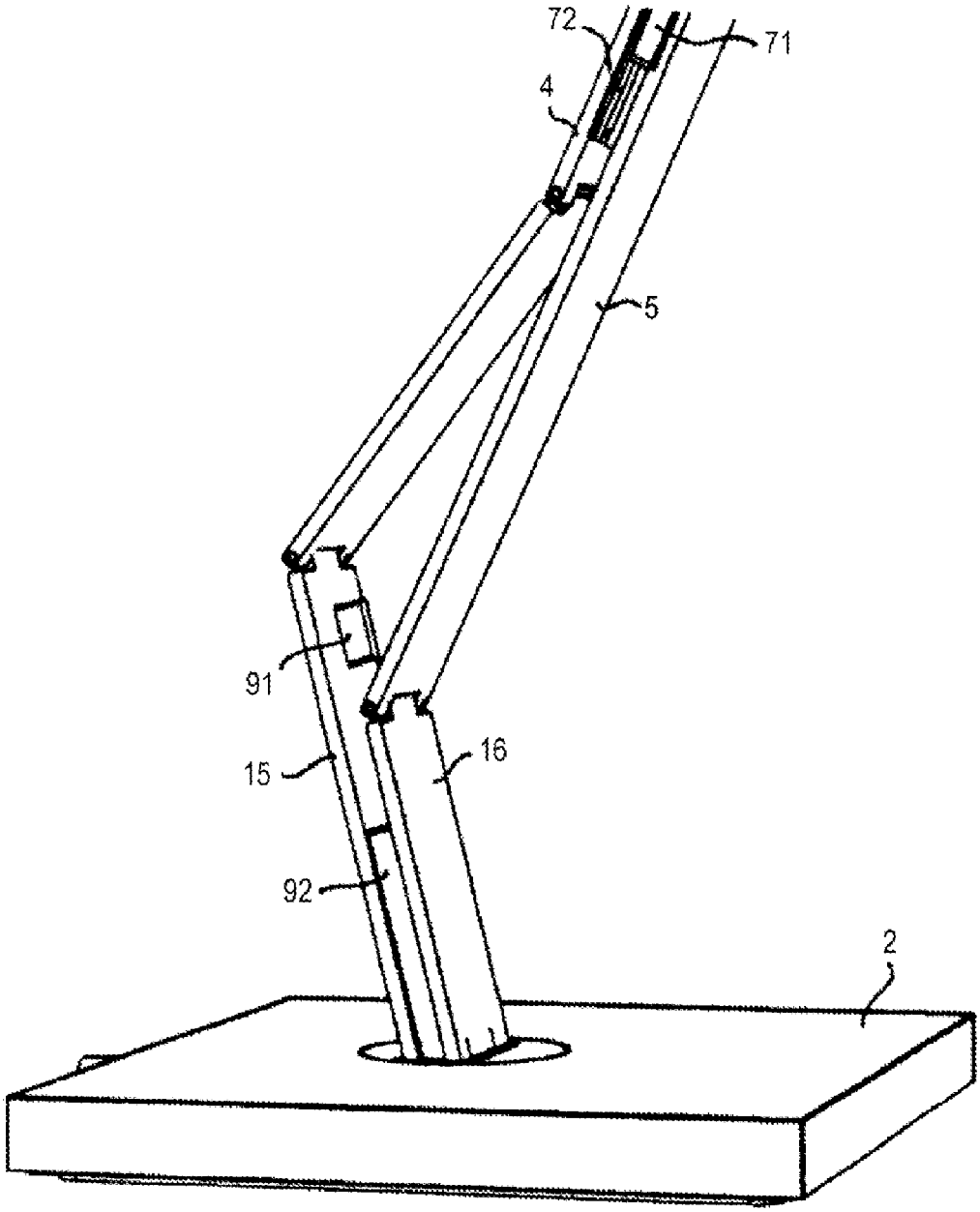
FIG. 8 shows a detailed view of the region of the base plate.

As shown in FIG. 8, the two further spacing elements 9 are provided close to the base plate 2 in the form of spacing elements 91, 92. In this region, in particular when the lamp head 3 is adjusted, by comparison particularly large lever forces can occur; the two further spacing elements 91, 92 ensure that there is reliable spacing of the two profile runs 15, 16 in this region.

Figure 7:
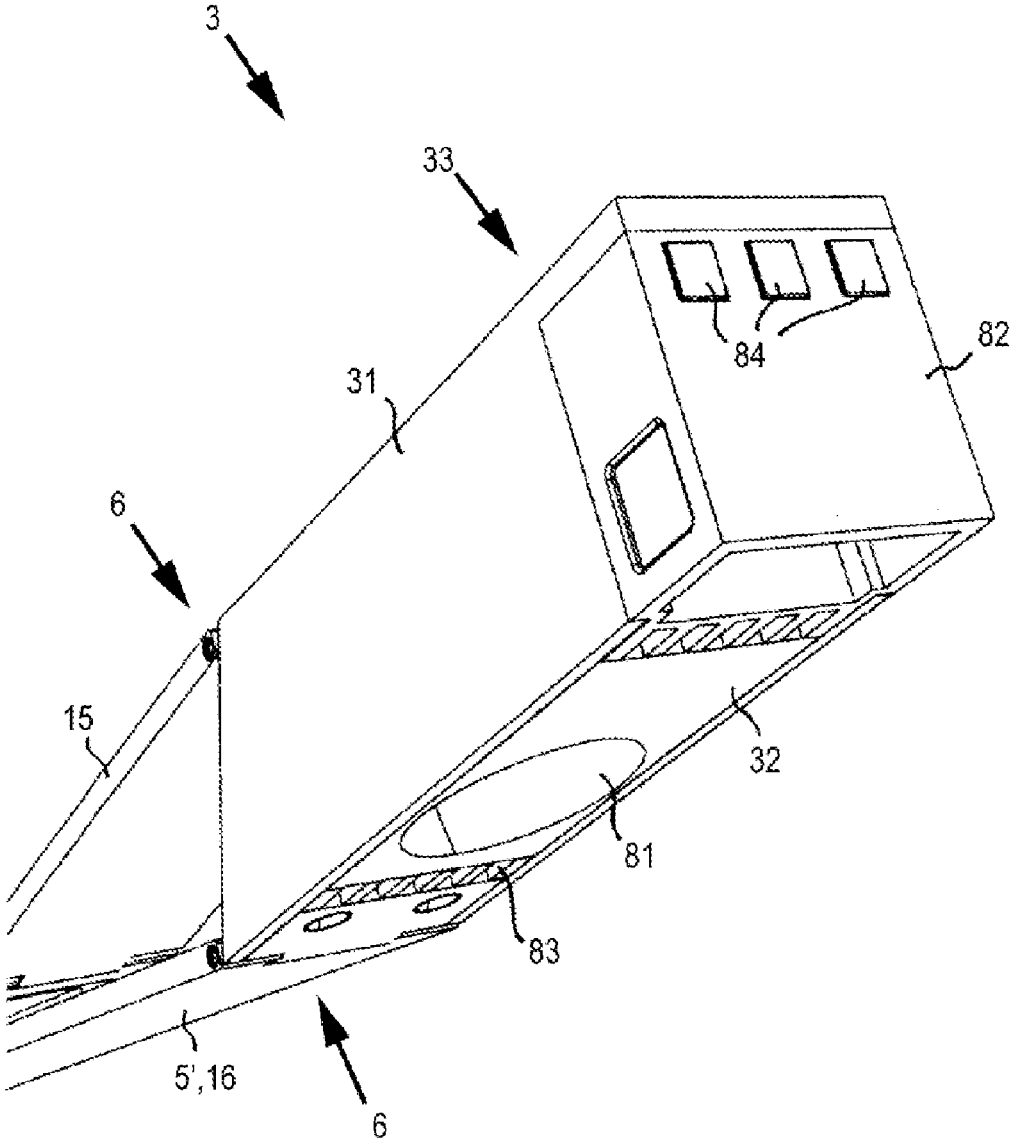
FIG. 7 shows a detailed view of the lamp head.

The lamp head 3 is shown in greater detail in FIG. 7. The lamp head 3 in the case of this exemplary embodiment comprises a view portion 31 that is constructed as a profile portion embracing the lamp head 3 at the side and at the top.

A high-power LED that has a plurality of closely lying light points is provided as a light source. A structured reflector 81 is provided in the lamp head 3 in such a way that the light of the light source is emitted asymmetrically outwards through the reflector 81.

Furthermore, an electronic component for dimming the lamp 1 is provided in the lamp head 3.

Furthermore, an integrated cooling arrangement, here in the form of ventilation slots 83, is provided that ensures that the light source is cooled. The ventilation slots 83 are made of aluminum and extend from the underside 32 of the lamp head 3 throughout as far as the upper side 33. The ribs of the ventilation slots 83 in each case end so that they are flush with the outer face of the view portion 31.

The view portion 31 is preferably made of the same material as the profile elements 4, 5. The surface of the view portion 31, in particular that of the side faces of the view portion 31, is then preferably treated in the same way as the surfaces of the side walls 41, 42, 51, 52 of the two profile elements 4, 5. In this way, a corresponding visual unit can be formed with the lateral faces of the profile runs 15, 16.

A user-friendly operating part 82 made, for example, from thermoplastic elastomer ensures that there is ease of operation at the lamp head 3. The operating part 82 comprises buttons 84 which are preferably integrated in such a way that they are inconspicuous visually; a laser inscription or print is provided in order to explain the corresponding functions (LOW ON/OFF HIGH). In particular, a switch in the form of a button for switching on and off and also a further button to control the brightness are provided. The electronic components that are required for this are provided in the lamp head 3. The operating part 82 is provided in an operator-friendly manner on the end face of the lamp head 3.

The base plate 2 is configured in such a way that rotation of the rest of the lamp about an axis of rotation projecting vertically from the base plate 2 is rendered possible. For this, as is evident by way of indication in FIG. 8, a friction joint is provided, that is, with two end stops to limit the rotation.

The base plate 2 is kept as shallow as possible. An operating device is preferably provided in the form of an external operating device, thereby rendering possible a configuration of the base plate 2 that is as shallow as possible.

LIST OF REFERENCE NUMERALS

1 Lamp
2 Base plate
3 Lamp head
4 First profile element
5 Second profile element
4', 5' Further profile elements
6 Joints

7 Guide element
7' Further guide element
9 Spacing elements
10 Triangular portion
15 First profile run
16 Second profile run
21 First main arm
22 Second main arm
31 View portion of the lamp head
32 Underside of the lamp head
33 Upper side of the lamp head
41 First side wall of the first profile element
42 Second side wall of the first profile element
51 First side wall of the second profile element
52 Second side wall of the second profile element
71 First rail element of the first guide element
71' First rail element of the further guide element
72 Second rail element of the first guide element
72' Second rail element of the further guide element
73 Spring element
74 First holding element
75 Second holding element
76 Leaf spring
77 Screw
80 High-power LED
81 Reflector
82 Operating part
83 Ventilation slots
84 Buttons
91, 92 Further spacing elements

The invention claimed is:

1. A lamp comprising:

a base plate, a lamp head, two profile elements mounting the lamp head to the base plate, the two profile elements extending side by side, a guide element in a section between the two profile elements that effects guided parallel displacement of the two profile elements, and a spring element which, in the case of a parallel displacement of the two profile elements, produces a restoring force that acts on the profile elements, wherein the profile elements comprise current-conducting elements.

2. A lamp according to claim 1, wherein the profile elements are made of aluminum.

3. A lamp according to claim 1, wherein the profile elements have joints for adjusting the lamp head into a desired position.

4. A lamp according to claim 3, wherein the joints have electrically conductive elements in order to assist in current-conduction.

5. A lamp according to claim 3, comprising a plurality of profile elements connected by the joints and defining a profile run extending throughout from the base plate to the lamp head.

6. A lamp according to claim 5, comprising two profile runs that each extend throughout and separately from each other from the base plate to the lamp head.

7. A lamp according to claim 1, comprising means for setting a frictional force that occurs in the case of the parallel displacement of the profile elements.

8. A lamp according to claim 1, wherein the guide element comprises two interlocking rail elements that are displaceable parallel to each other.

9. A lamp according to claim 1, comprising an end stop for the guided parallel displacement of the two profile elements.

10. A lamp according to claim 1, wherein the guide element in all of the intended positions of the lamp head relative to the base plate guarantees electrical insulation of the two profile elements.

11. A lamp according to claim 1, wherein the lamp head comprises a light source in the form of an LED.

12. A lamp according to claim 11, wherein the lamp head comprises a reflector through which the light of the light source is emitted asymmetrically.

13. A lamp according claim 1, wherein provided on the lamp head comprising an operating part in the lamp head.

14. A lamp according to claim 1, comprising an electronic component to dim the lamp in the lamp head.

15. A lamp according to claim 1, wherein the base plate is configured in such a way that rotation of the rest of the lamp relative to the base plate is possible.

16. A lamp according to claim 1, wherein the guide element does not protrude laterally beyond the two profile elements.

17. A lamp according to claim 1, wherein the guide element is produced from an electrically non-conductive material.

18. A lamp according to claim 1, wherein the spring element is located in an interior space between two rail elements formed in the guide element.

19. A lamp according to claim 18, further comprising a leaf spring disposed within the interior space between the two rail elements, and a screw that passes through one of the profile elements, the screw being adapted to vary a spring force of the leaf spring when the screw is rotated.

* * * * *